US006509679B1

(12) United States Patent
Ligthart et al.

(10) Patent No.: US 6,509,679 B1
(45) Date of Patent: Jan. 21, 2003

(54) TENSION MASK AND FRAME WITH MECHANICAL CONNECTION MEANS

(75) Inventors: Henricus J. Ligthart, Eindhoven (NL); Piet C. J. Van Rens, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/447,547

(22) Filed: Nov. 23, 1999

(30) Foreign Application Priority Data

Nov. 27, 1998 (EP) ..... 98203994

(51) Int. Cl.[7] ..... H01J 29/07
(52) U.S. Cl. ..... 313/407
(58) Field of Search ..... 313/402, 404, 313/407

(56) References Cited

U.S. PATENT DOCUMENTS 4,748,370 A * 5/1988 Van Den Broek ..... 313/404
4,859,901 A * 8/1989 Thompson-Russell ..... 313/403
5,424,603 A * 6/1995 Van Den Bekerom ..... 313/407
5,686,784 A * 11/1997 Thoms et al. ..... 313/402
5,929,558 A * 7/1999 Lee ..... 313/402
5,952,774 A * 9/1999 Diven et al. ..... 313/402

FOREIGN PATENT DOCUMENTS

EP 0228110 A1 11/1986 ..... H01J/29/07
EP 0599400 A1 6/1994 ..... H01J/9/14

* cited by examiner

*Primary Examiner*—Michael Day

(57) ABSTRACT

A color selection means is described in which the mask (50) is stretched under tension and connected to a support frame. The support frame accurately determines the mask contour, while the mask is connected to this frame in a flexible way by mechanical means so that differences in expansion behavior of the mask and the frame can be handled. These connection means can be either lugs or resilient elements (59).

Such a color selection means may be used in a color display tube having an at least substantially flat display screen.

10 Claims, 7 Drawing Sheets

TENSION MASK AND FRAME WITH MECHANICAL CONNECTION MEANS

BACKGROUND OF THE INVENTION

The invention relates to a colour selection means for colour display tubes, comprising a mask and a frame, which frame includes a plurality of interconnected parts each forming a side of the frame, whereby at least two opposite frame parts are each formed by a pipe having a first pipe side which has an accurately defined edge, a second pipe side which is connected to the first pipe side along a path which does not project beyond the edge of the first pipe side, and at least one third pipe side which is located between the first and the second pipe side, the mask closely engaging the edge of the first pipe side, whereby the mask is stretched under tension and connected to at least two of the interconnected parts of the frame.

The invention also relates to a colour display tube provided with a colour selection means of the type referred to above.

A colour selection means as described above is disclosed in European Patent Application EP-A-0599400. The colour selection means described therein consists of a frame and a mask. The frame is built up from separate frame parts, namely the pipes, and the mask is stretched over the frame and secured to it. Such a construction can be used for the development of flat colour display tubes. In EP-A-0599400 only the frame construction is disclosed; the assembly of mask and frame is not described.

Colour display tubes are usually provided with a colour selection means to shadow the electron beams originating from the three electron guns mounted in the neck of the tube, so that each beam excites only electroluminescent material of one colour that is deposited on the inside of the panel. This colour selection is achieved by applying, for instance, a shadow mask in the tube. This mask comprises a large number of apertures which, in most cases, are arranged in a striped pattern or a dotted pattern. Conventional colour display tubes have a curved faceplate, in most cases it resembles either a spherical or a cylindrical surface. Recently, more and more colour display tubes tend to have a(n) (almost) flat faceplate. As a consequence, also the colour selection means will become flatter and flatter. The existing techniques to manufacture a colour selection means have shortcomings in the case of a substantially flat shadow mask, so that new ways of constructing suspensions for these shadow masks must be found.

One of the important performance-related issues in present-day colour display tubes is the doming behaviour. In fact, doming is the discolouration of the display due to local heating of the shadow mask. When the mask is heated, it will expand and, as a consequence, the electron beams will not impinge on the appropriate electroluminescent material on the panel. This misregistration causes a lack of the relevant colour, or even worse, electroluminescent material of the wrong colour is excited.

OBJECTS AND SUMMARY OF THE INVENTION

It is an object of this invention to provide a colour selection means construction in which the mask is connected to the frame in such a way that the requirements for obtaining a substantially flat colour display device are met.

According to the invention, a colour selection means of the type described in the opening paragraph is characterized in that the mask is connected to the frame by mechanical connection means that provide a flexible construction.

The invention is based on the recognition that by using a flexible construction to connect the mask to the frame, it is possible to construct a mask-frame combination which overcomes the doming difficulties in a colour display tube incorporating a substantially flat shadow mask. The flexible connection between the frame and the mask will compensate for differences in expansion between the mask and the frame. The mounting construction of the mask-frame assembly in the panel will also correct the misregistrations that will occur if the mask is heated as a consequence of incident electrons.

The invention is described using a frame that comprises folded pipes, however this should not be seen as a limitation of the invention. The frame may equally well comprise, for instance, extruded pipes or solid bars as supporting frame parts.

A preferred embodiment of the colour selection means according to the present invention is characterized in that the pipes of the frame are weak in terms of torsion properties. In a symmetrical construction, the frame parts only have to be stiff upon bending if a mask is stretched over the frame. This means that no severe demands have to be made with respect to the torsion properties of such a frame part, which makes the construction easier.

A further embodiment of the colour selection means according to the present invention is characterized in that the connection means comprise lugs connecting the mask to the frame. The mask is connected to the frame by a construction that allows the mask to shift in the direction of the frame pipe to which it is connected. This direction is transverse to the direction in which the mask is stretched. By virtue of this construction, differences in expansion between the mask and the frame are compensated for.

A further embodiment of the colour selection means according to the present invention is characterized in that the connection means comprise a resilient element connecting the mask to the frame. The mask is connected to the frame by a construction that allows the mask to shift with respect to the frame in the two directions of the plane of the mask which are perpendicular to the tube axis. This construction ensures that differences in expansion between the mask and the frame are compensated for. The advantage of resilient elements over lugs is demonstrated by the fact that in the case of resilient elements also the differences in expansion between the mask and the frame in the stretching direction are compensated.

A further embodiment of the colour selection means according to the present invention is characterized in that the mask comprises 'blind edges', having a plurality of areas of reduced thickness. The presence of areas of reduced thickness is advantageous to compensate an effect which is referred to as called transverse contraction. When a mask is stretched under tension the blind edges cause discontinuous stretch in a direction which is more or less transverse to the stretching direction, which leads to undesired tensions and even wrinkles in the mask. This problem may be overcome by partly removing mask material from the regions of the blind edges.

BRIEF DESCRIPTION OF THE DRAWINGS

These and other aspects of the invention will be apparent from and elucidated with reference to the embodiments described hereinafter. In the drawings.

DESCRIPTION OF THE PREFERRED EMBODIMENTS

Figure 1:
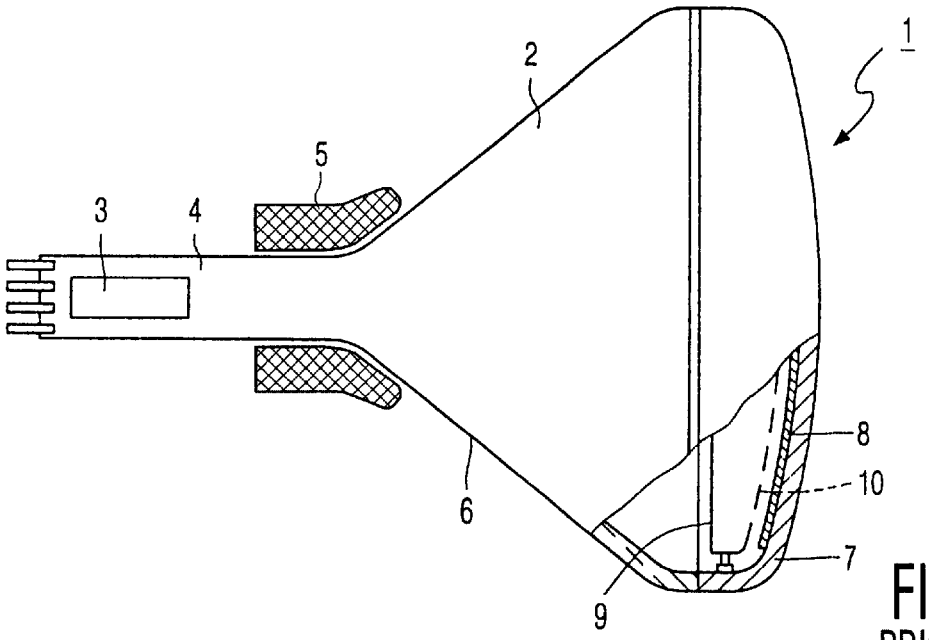
FIG. 1 PRIOR ART
FIG. 1 is a side elevation, partly broken away, of a known colour display tube with a colour selection means.

The cathode ray tube 1 shown in FIG. 1 comprises an evacuated glass envelope 2 with a neck 4, a funnel shaped part 6 and a front panel 7, which can be either curved or flat. On the inside of the panel 7 a display screen 8 having a pattern of for example lines or dots of phosphors luminescing in different colours (e.g. red, green and blue) may be arranged. A rectangular frame 9 supports a thin mask 10 at a small distance from the display screen 8. The mask 10 may be a mask having circular or elongate apertures, or a wire mask. During operation of the tube an electron gun system 3 arranged in the tube neck 4 sends electron beams through the mask 10 to the display screen 8 so that the phosphors will emit light. A deflection device 5 ensures that the electron beams systematically scan the display screen.

It is noted that the invention will be elucidated by making use of a frame that comprises folded pipes, but the invention can be used just as advantageously in combination with a frame of which the supporting parts are manufactured in a different way, such as extruded pipes or solid bars.

Figure 2:
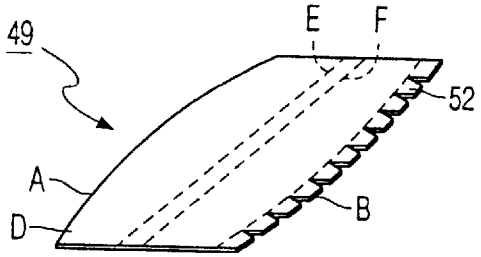
FIG. 2 PRIOR ART
FIG. 2 shows a known structure including a pipe for supporting a frame in an unfolded form.
Figure 3A:
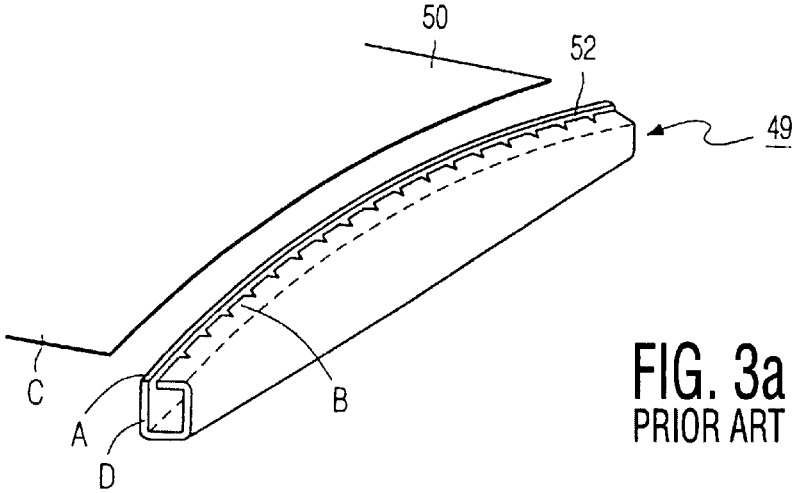
FIG. 3a PRIOR ART
FIG. 3*a* shows a known structure of the pipe for the supporting frame of the colour selection means.
Figure 3B:
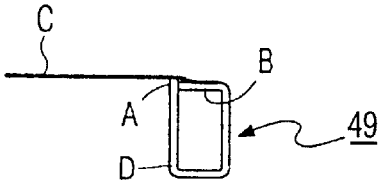
FIG. 3b PRIOR ART
FIG. 3*b* shows a diagrammatic cross-section of a known pipe for the supporting frame of a colour selection means.

FIG. 2 shows an embodiment of a supporting part, pipe 49, for a mask frame in an unfolded state as is disclosed in EP-A-0599400. The supporting part 49 is cut from a metal sheet, while especially line A follows a very accurately curved path. In the case of a flat shadow mask, path A will be a straight line. The pipe 49 is formed by folding the plate at the positions marked with E and F, and securing side B by means of the welding lugs 52 to side D of which A is the edge. The pipe thus obtained is shown in FIG. 3*a*. The mask 50 is clamped onto the edge A and secured to the surface by means of the welding lugs 52 (FIG. 3*b*). Because the welding lugs 52 do not project beyond the edge A, the mask 50 will closely engage this accurately cut edge, resulting in a high accuracy of the mask shape.

Figure 4:
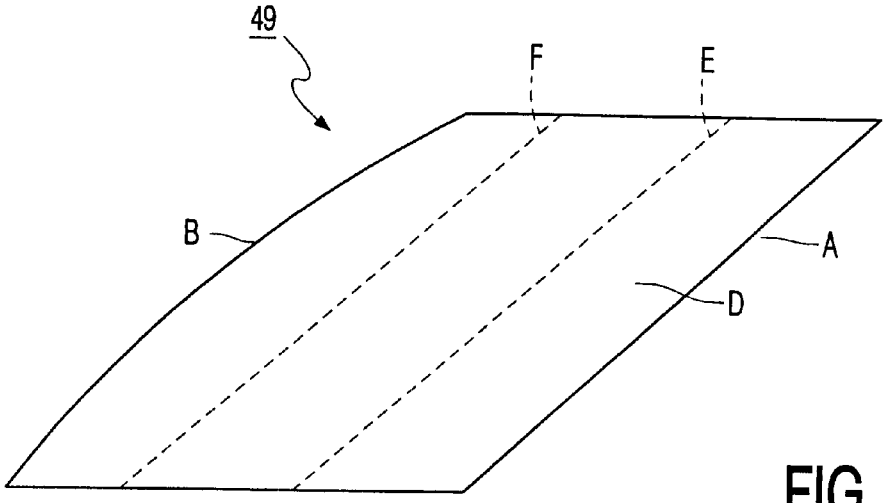
FIG. 4 shows a second embodiment of a pipe for a supporting frame in an unfolded form.
Figure 5A:
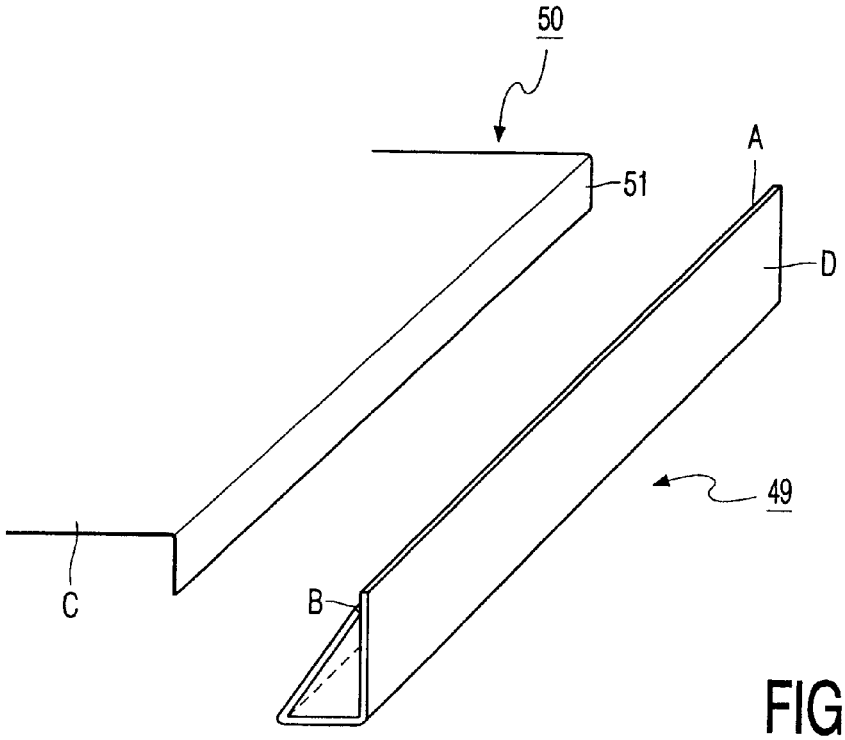
FIG. 5*a* shows the second embodiment of the folded pipe for the supporting frame of the colour selection means according to the invention.
Figure 5B:
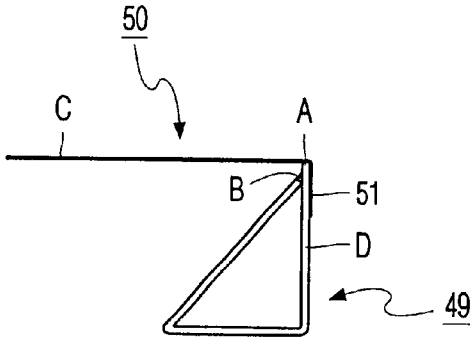
FIG. 5*b* shows a diagrammatic cross-section of the second embodiment of the folded pipe for the supporting frame of the colour selection means according to the invention.

FIG. 4 shows a second embodiment of a folded pipe for a flat shadow mask. In this embodiment a triangular pipe 49 is obtained, see FIG. 5*a*, in which edge B again does not project beyond edge A. The mask 50 may have bent edges 51, with which it is secured to the pipe side D near the edge A, as shown in FIG. 5*b*.

Figure 6:
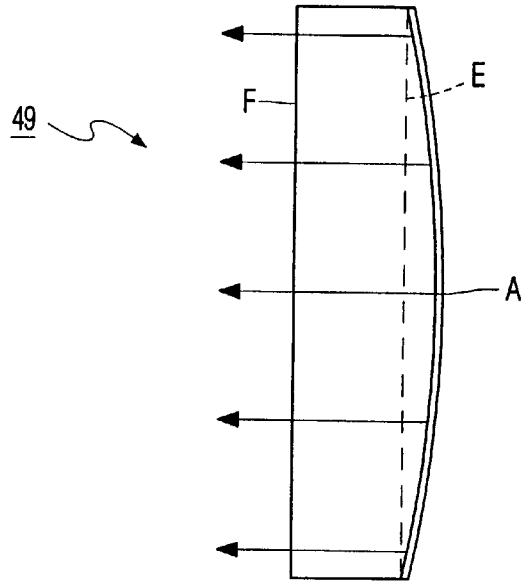
FIG. 6 is a top view of the second embodiment of the pipe for the supporting frame of the colour selection means according to the invention.

In this embodiment the welding lugs 52, as shown in FIG. 3*a*, on edge B are not required. By giving a well-defined curvature to the edge B, it is possible to give the overall pipe construction a curvature perpendicular to plane D, so that the folded pipe 49 is straightened by the forces in the tensioned mask. In this case the curvature of the edge B is such that the edge A is bent outward in the central part, as is shown in the top view of the pipe in FIG. 6.

Figure 7A:
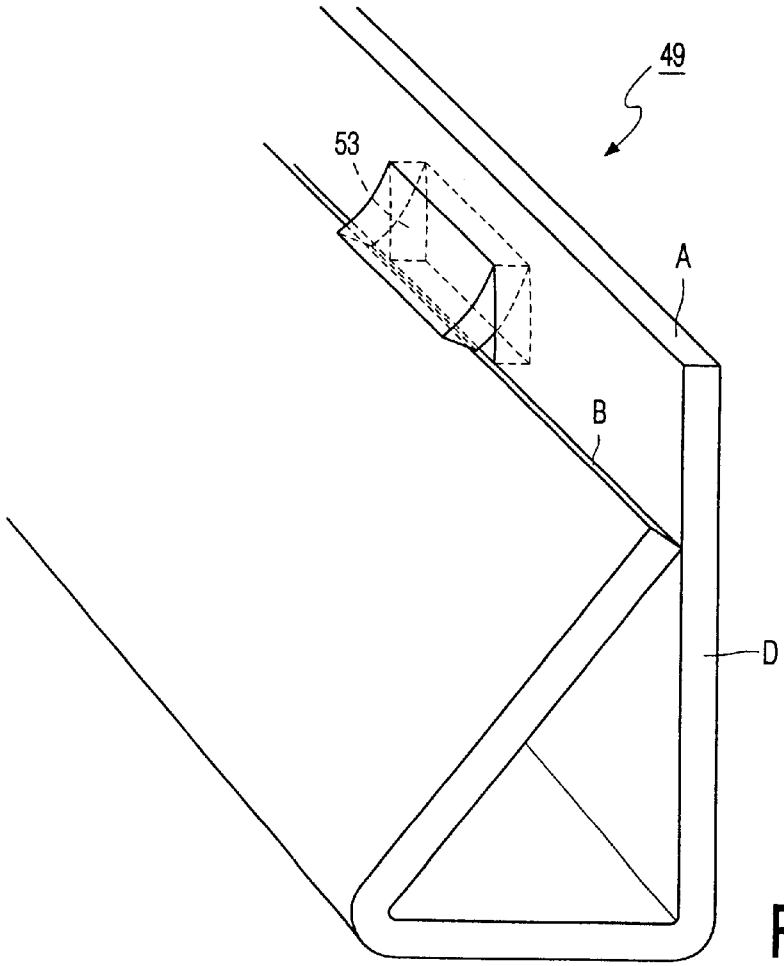
FIGS. 7*a* and 7*b* show possible techniques for closing the pipe of the second embodiment of the supporting frame of the colour selection means.
Figure 7B:
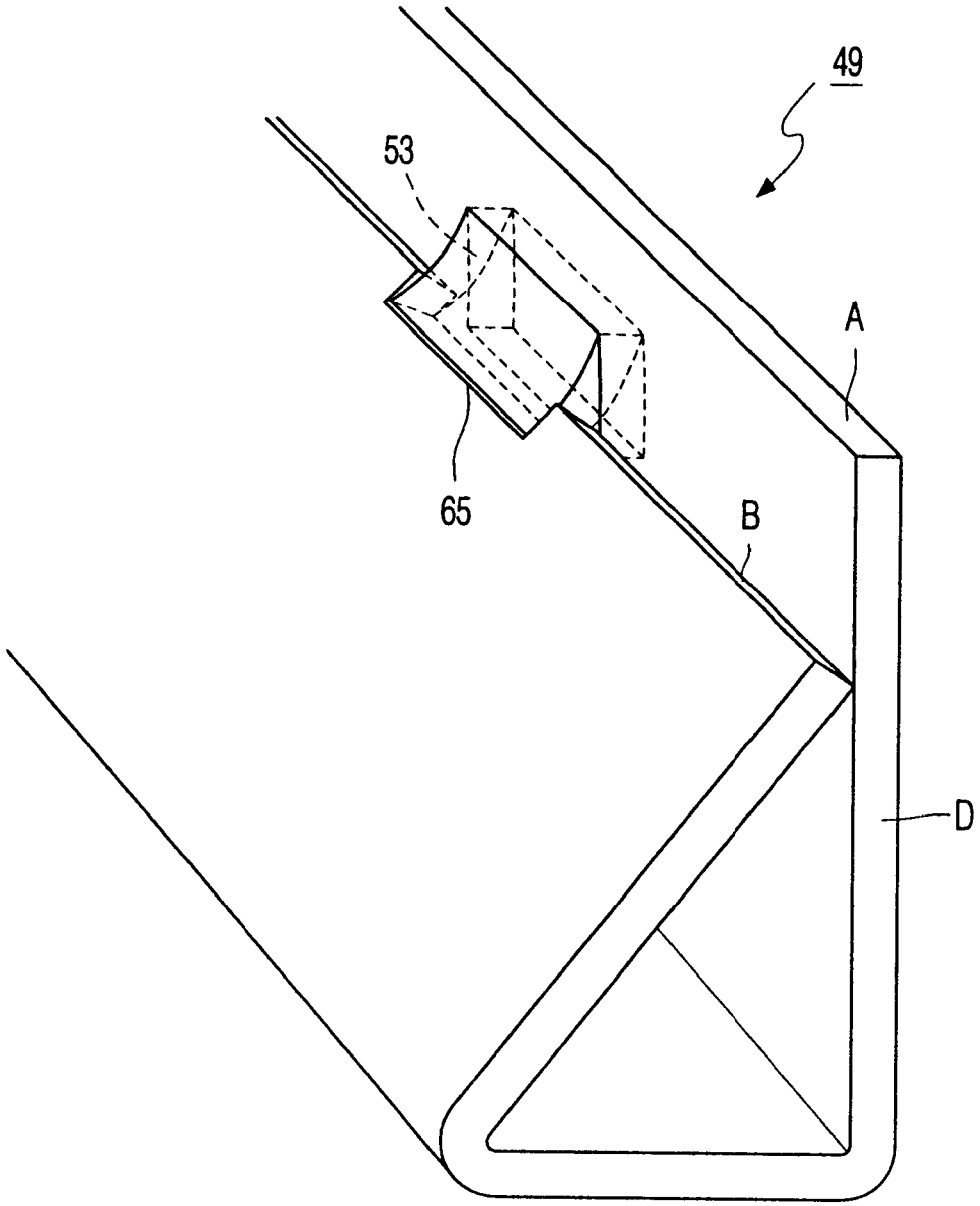

In FIGS. 7*a* and 7*b* possible assembly techniques for the pipe 49 are given. In case such a pipe is only subjected to a symmetric load due to the stretched mask, there is no reason for welding the pipe over the entire length. In this case only a few welding spots will suffice. In order to prevent mechanical stress in the pipe material it is also possible to assemble the pipe by a mechanical (non-welding) technique. Such a process is even preferred, because it can make annealing of the frame parts superfluous. An example of such techniques is given in FIGS. 7*a* and 7*b*, where some lips 53 are partly recessed in side D of the pipe, said lips being used for clamping the edge B. In FIG. 7*a* it is desired to have a few welding spots in order to prevent torsion in the pipe. The construction of FIG. 7*b* has the advantage that the welding spots can be omitted; the cut-away areas 65 prevent torsion in the pipe. Due to the direction of the tension in the mask 50, a rigid construction will be used, which has the advantage that the pipe may be weak in terms of torsion behaviour. Weak in this sense means weak as compared to a pipe that is welded over the entire length. The term torsion is to be taken to mean in this context the torsional moment over the entire tube length; this torsion behaviour can be weak because the load in the pipe is symmetrical with respect to the centre of the pipe.

Figure 8A:
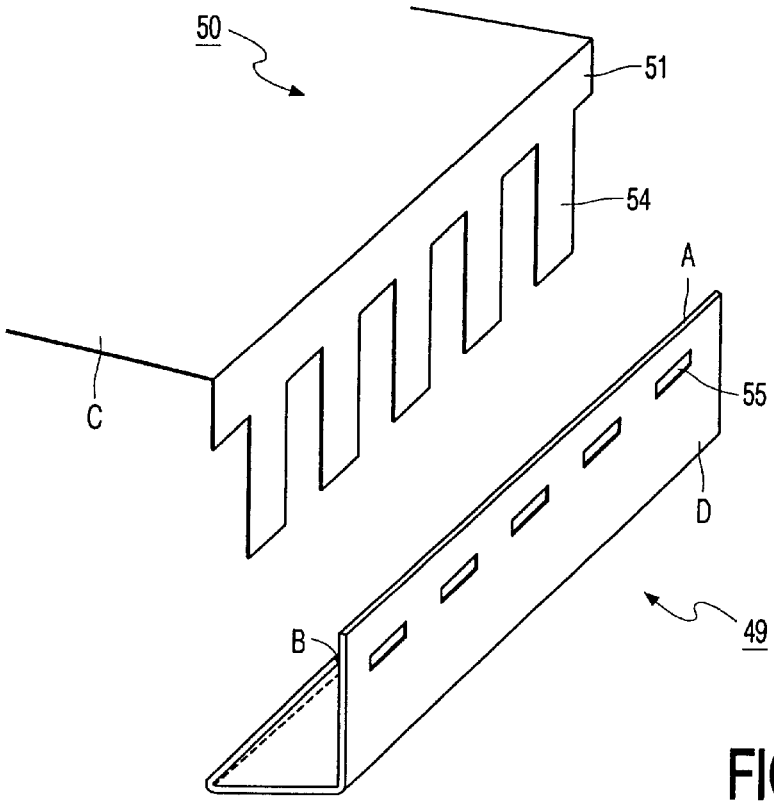
FIG. 8*a* shows a first embodiment of connection means comprising lugs for connecting the mask to the frame.
Figure 8B:
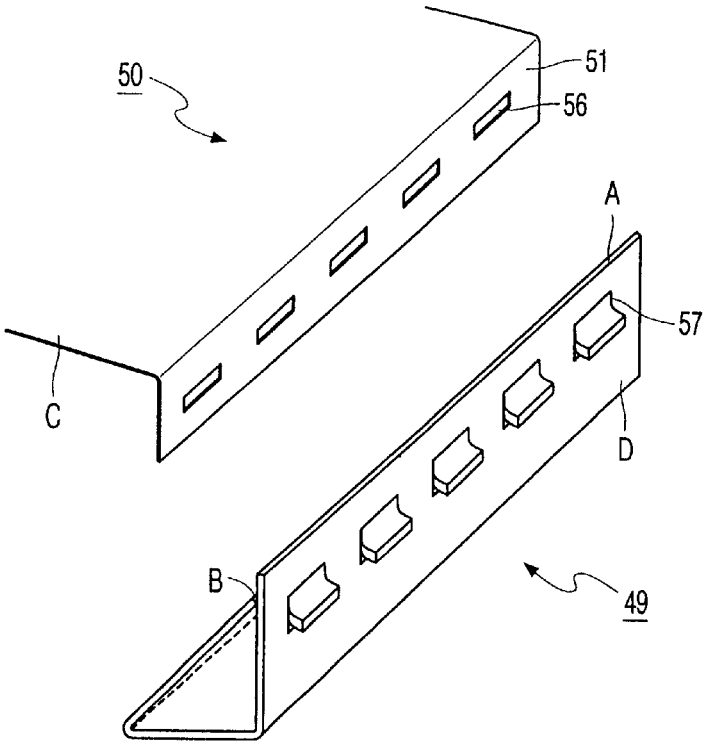
FIG. 8*b* shows a second embodiment of connection means comprising lugs for connecting the mask to the frame.

In FIGS. 8*a* and 8*b* examples are given of connection means for connecting the mask to the frame, which connection means comprise lugs. In the first embodiment, as shown in FIG. 8*a*, the mask 50 comprises a comb-like structure with a plurality of teeth 54 that fit into corresponding slits 55 that were cut from side D of the frame part 49. Due to the fact that the mask 50 is stretched under tension, the friction that exists between the mask 50 and the frame will keep the mask well positioned.

As an alternative to this construction, the slits 55 can be omitted and the comb-like structure 54 connected to the pipe side D by spot welding the end of the teeth of the comb-like structure 54 to pipe side D. This is also a flexible connection between the mask 50 and the frame pipe 49, because the shape of the teeth of the structure 54 make it possible to compensate for differences in expansion between the mask and the frame are compensated.

A second example, as shown in FIG. 8*b*, shows a case in which the mask comprises a plurality of slits 56 that can be secured on the extruded lugs 57 on the frame part.

For both these examples it is possible to remove the differences in expansion coefficients that can occur between the mask 50 and the frame, by making the slits 55 or 56 extending from the centre to the edge relatively slightly wider than the so-called lugs 54 or 57. As a result thereof, when, for instance, the mask 50 expands with respect to the frame, the centre part of the mask edge is kept fixed, and the outer areas of the mask shift a little bit towards the outside in the direction of the line on which the slits 55 or 56 are positioned.

FIG. 9 shows a construction in which the mask 50 is connected to the frame, the connection means comprising resilient elements 59. An example of a resilient element is a spring. In EP-A-0228110 similar connection techniques are disclosed, but the mask position is poorly determined by the position and the shape of the springs. In the present invention, an accurately determined mask position is obtained by positioning the mask using the well-defined edge A of the pipe side.

Figure 9A:
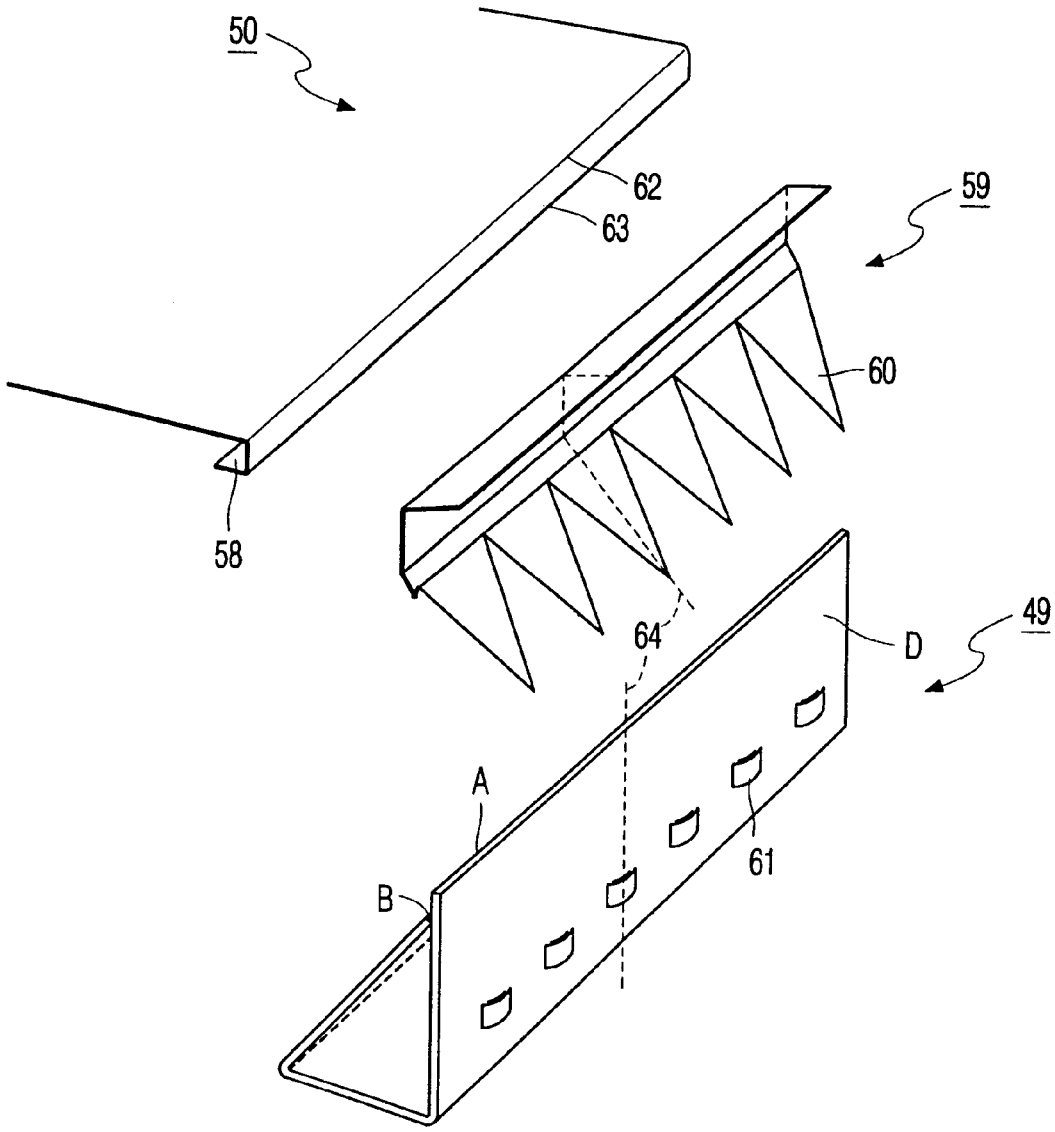
FIG. 9*a* shows an embodiment of connection means comprising a resilient element for connecting the mask to the frame.
Figure 9B:
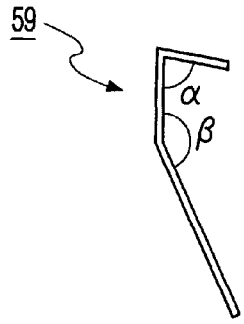
FIG. 9*b* shows a cross-sectional view of the resilient element.
Figure 9C:
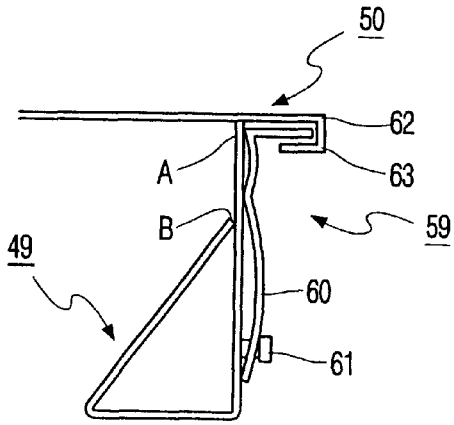
FIG. 9*c* shows a cross-sectional view of the embodiment when the mask, the resilient element and the frame are connected together.

In FIG. 9*a* the separate components are shown, such as the mask 50, the frame pipe 49 and the spring 59 that will connect together the mask and the frame pipe. FIG. 9*b* shows a cross-sectional view of the spring 59 when it is not under tension, while FIG. 9*c* shows a cross-sectional view of the assembly of the mask 50, the spring 59 and the frame pipe 49. Both cross-sectional views are taken at the position indicated by a dashed line 64 where a virtual plane intersects the spring 59 and the frame pipe 49.

In this embodiment the spring comprises a comb-like structure with a plurality of teeth 60 that fit into pressed-through eyes 61 of the frame pipe 49. These teeth 60 can, for instance, be triangular (as in FIG. 9*a*) or pin-shaped. Again, by making the pressed-through eyes 61 slightly larger at the edges than in the centre of the pipe 49, it becomes possible for the mask 50 to shift along this line and thus compensate the difference in expansion between the mask 50 and the frame part 49. If a comb-like structure with pin-like teeth is used, in which the width of the teeth is much smaller than the pitch of the teeth, there is no need to make the pressed-through eyes 61 larger at the edges. Possible differences in expansion between the mask 50 and the frame part 49 are handled by a small deformation of the teeth.

The spring is shown to have two kinks, denoted by the angles $\alpha$ and $\beta$, indicated in FIG. 9*b*. The angle $\alpha$ is preferably close to, but slightly smaller than 90°, while the value of the angle $\beta$ is determined by the stiffness of the spring in combination with the desired spring force on the mask.

The mask 50 is connected to the spring element 59 by providing it with two folding edges 62 and 63 which are hooked around the top part of the spring 59.

After the mask 50 is stretched, the spring 59 will deform to the shape schematically drawn in FIG. 9*c*. In this configuration, differences in expansion of the frame and the mask 50 are compensated. Let us assume that the expansion of the frame with the spring 59 is larger than the expansion of the mask 50; in that case the tension in the spring 59 will increase, but the position of the mask 50 will not change. In the direction transverse to the stretching direction of the mask 50, the mask can shift along the top part of the spring element 59. The position of the mask 50 with respect to the panel 7 is fixed by ensuring that the mask closely engages the edge A of the frame pipe 49. This situation will occur, for example, when the mask is made from invar and the frame from iron.

It should be noted, for example, that it is not necessary for all the frame parts to have the same expansion coefficients. If the expansion coefficients of the north and south pipes differ from the expansion coefficients of the east and west pipes, these differences are compensated as well, because the compensation in the stretching direction is carried out by the resilient elements 59, and in the transverse direction compensation is obtained by the fact that the resilient element 59 can shift with respect to the frame part 49.

In order to obtain a construction having a good performance in terms of registration properties, it is necessary that, in case the mask expands, the apertures of the mask shift along the path of the electron beams. This situation can be achieved by connecting the mask 50 or the spring 59 to the panel by making use of specially constructed springs or other resilient elements that only allow the mask to move in the direction of the electron beam path. Such springs for connecting a mask-frame combination to a panel are known per se. By using such springs, the expansion differences are compensated in such a way that the electron beams will not land on electroluminescent material of the wrong colour; this so-called compensation for misregistration errors clearly improves the tube performance. An example of such springs are the well-known TC (Temperature-Compensated) springs.

By stretching the mask under tension, either unidirectionally or bidirectionally, the problem of the formation of wrinkles in the so-called blind edges of the mask may arise. Blind edges are the parts of the mask without apertures close to the supporting frame.

When a mask is subjected to tension, the blind edge causes a discontinuous strain in a direction more or less transverse to the direction in which the mask is stretched. This discontinuity in the so-called transverse contraction leads to undesired tensions in the mask material, and even to wrinkles in the mask.

Figure 10:
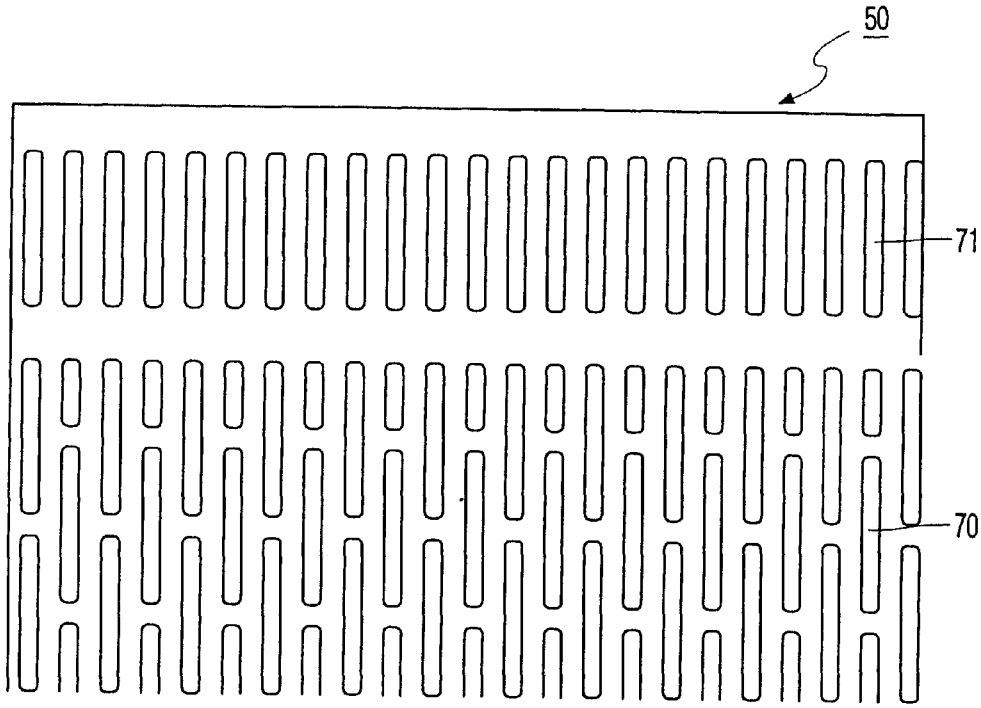
FIG. 10 shows an example of the blind edge of a mask that has been partially etched in order to compensate for the transverse contraction.

This problem can be solved by applying less mask material in the blind edge; the term less should be interpreted as less with respect to the application of the 'raw' mask material (i.e. without apertures or etching process). This can, for instance, be achieved by making the blind edge thinner than the rest of the mask by either pressing it or partially etching it. FIG. 10 shows an example of a mask 50 the blind edge of which has been partially etched in order to compensate for the transverse contraction. The Figure shows a part of the shadow mask 50 in which slits 70 are the mask apertures for transmitting the electron beams and areas 71 are the partially etched regions of the blind edge. The areas 71 are shaded in grey in order to demonstrate that they are partially etched, i.e. these areas are not apertures. The dimensions of the slits 70 and areas 71 are not to scale, neither is the ratio between the surfaces of the slits 70 and areas 71.

In the case of a unidirectionally stretched mask, as can be used for flat or nearly flat colour display tubes, the mask may for example be stretched in the vertical direction along the north and south edges. In such a situation it is preferred to compensate the transverse contraction in the north and south edges by reducing the mask material in these edges.

What is claimed is:

1. A colour selection means for colour display tubes, comprising a mask and a frame, which frame includes a plurality of interconnected parts each forming a side of the frame, whereby at least two opposite frame parts are each formed by a pipe having a first pipe side which has an accurately defined edge, a second pipe side which is connected to the first pipe side along a path which does not project beyond the edge of the first pipe side, and at least one third pipe side which is located between the first and the second pipe side, the mask closely engaging the edge of the first pipe side, whereby the mask is stretched under tension and connected to at least two of the interconnected parts of the frame, and the mask is connected to the frame by mechanical connection means that provide flexible construction; and a position of at least a center of the mask relative to a panel remains fixed.

2. A colour selection means as claimed in claim 1, characterized in that the pipes of the frame are weak in terms of torsion properties.

3. A colour selection means as claimed in claim 1, characterized in that the connection means comprise lugs connecting the mask to the frame.

4. A colour selection means as claimed in claim 1, characterized in that the connection means comprise lugs and slits connecting the mask to the frame, that cooperate in such a way that the lugs and slits can shift with respect to each other.

5. A colour selection means as claimed in claim 1, characterized in that the connection means comprise a resilient element connecting the mask to the frame.

6. A colour selection means as claimed in claim 1, characterized in that the connection means comprise a resilient element and slits connecting the mask to the frame, that cooperate in such a way that the resilient element and the slits can shift with respect to each other.

7. A colour selection means as claimed in claim 1, characterized in that the mask comprises 'blind edges' having a plurality of areas of reduced thickness.

8. A colour selection means as claimed in claim 1, characterized in that the second pipe side is re-entrant and the mask is connected to the first pipe side.

9. A colour selection means as claimed in claim 1, characterized in that the second pipe side has an outer boundary that is curved outwards.

10. A colour display tube provided with a colour selection means as claimed in claim 1.

* * * * *